US006283252B1

(12) United States Patent
Lee

(10) Patent No.: US 6,283,252 B1
(45) Date of Patent: Sep. 4, 2001

(54) LEVELING CONTROL DEVICE FOR ELEVATOR SYSTEM

(75) Inventor: Jea Pil Lee, Changwon (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 09/461,776

(22) Filed: Dec. 15, 1999

(30) Foreign Application Priority Data

Dec. 15, 1998 (KR) ..... 98-55141

(51) Int. Cl.[7] ..... B66B 1/40
(52) U.S. Cl. ..... 187/291; 187/293
(58) Field of Search ..... 187/281, 284, 187/289, 291, 292, 293, 295, 296, 297; 318/432, 798–815, 66, 80, 98

(56) References Cited

U.S. PATENT DOCUMENTS 4,380,049 * 4/1983 Makinen ..... 187/29 R
4,452,341 * 6/1984 Tanahashi ..... 187/29 R
4,738,337 * 4/1988 Caputo ..... 187/115
4,754,850 * 7/1988 Caputo ..... 187/115
5,025,896 * 6/1991 Arabori et al. ..... 187/115
5,325,036 * 6/1994 Diethert et al. ..... 318/802
5,542,501 * 8/1996 Ikejima et al. ..... 187/292
5,686,707 * 11/1997 Iijima ..... 187/291
5,698,823 * 12/1997 Tanahashi ..... 187/296
5,734,135 * 3/1998 Hakala et al. ..... 187/292
5,828,014 * 10/1998 Goto et al. ..... 187/292
6,075,332 * 6/2000 McCann ..... 318/432

FOREIGN PATENT DOCUMENTS 9202552 8/1997 (JP) .

* cited by examiner

*Primary Examiner*—Jonathan Salata

(57) ABSTRACT

The present invention relates to a leveling control device for an elevator system which estimates a load torque applied to an axis of an alternating current motor on the basis of a torque current component and a rotation angle of the alternating current motor, while carrying out a level compensation operation, and which compensates the torque current component for the difference between the estimated load torque and the load compensation torque by an output signal from a load detector, which results in an improved speed control property in the level compensation operation of the elevator system. In the elevator system controlling a rotation speed of the alternating current motor by dividing the current of the motor into a torque component current and a field current component, the leveling control device includes: a load torque estimation unit estimating a load torque from the torque current component and the alternating current motor speed; and a switch and an adder computing a difference between the load torque estimated by the load torque estimation unit and the load compensation torque corresponding to an amount of the load detected by the load detector, and adding the torque difference to the torque current component according to a level compensation command.

8 Claims, 8 Drawing Sheets

LEVELING CONTROL DEVICE FOR ELEVATOR SYSTEM

BACKGROUND OF THE INVENTION

1. Field of the Invention

The present invention relates to a technique of estimating a load applied to an output axis of a motor of an elevator car, and compensating a torque command current of the motor, and in particular to a leveling control device for an elevator system used for a level correction operating by a level difference between a designated floor bottom and an elevator car bottom generated when passengers get in/off after the elevator car stops at the designated floor.

2. Description of the Background Art

In general, a torque compensation method of compensating a torque corresponding to a load detected during movement by employing a load detector detecting a load of an elevator car (hereinafter, referred to as 'car') has been used in order to improve a ride comfort in an elevator system. According to the torque compensation method, there is a sufficient time to detect the load before closing a car door and moving the car, and thus the load of the car can be exactly detected. As a result, it is possible to control the motor to generate a torque compensation command appropriate to an amount of the detected load, and thus the ride comfort is relatively good.

However, when the car stops at the designated floor, the door is open and the passengers get in or off the car, a bottom level of the car is not identical to a bottom level of the designated floor according to a load variation, that is a level difference is generated. Here, the level difference is detected by using a position detection unit disposed at an upper portion of the car, and then out a level correction operating is carried out. However, the passengers constantly get in or off while the level correction operating is performed, and thus the load amount detected by the load detector has an error. Therefore, a speed control property of the elevator system compensating the load of the car is worsened. The conventional leveling control device for the elevator system will now be described in detail with reference to FIG. 1.

In order to move the car in an elevator system employing an alternating current motor, in case a torque of the alternating current motor is controlled by dividing a control current supplied to the alternating current motor into two vectors, namely a torque component current and a magnetic flux component current, an almost identical property to the control property of a direct current motor can be obtained. Accordingly, the vector control method has been used for the alternating current motor control for the elevator system. As illustrated in FIG. 3, the conventional elevator system using the vector control method includes an alternating current power source AC and a converter 101 converting an alternating current from the alternating current power source AC into a direct current. A condenser 102 for smoothing a ripple component included in an output from the converter 101 is connected to the output from the converter 101. An inverter 103 for converting a direct current voltage outputted from the condenser 102 into an alternating current voltage is connected across the condenser 102. An alternating current motor 106 is connected to an output from the inverter 103 to be driven in a clockwise or counterclockwise by an alternating current supplied from the inverter 103. A sheave 108 is connected to an output axis of the alternating current motor 106, and rotated in a clockwise or counterclockwise. A rope winds around the sheave 108. A car 109 lifted/lowered in a hoist way for loading passengers or cargo is connected to one end of the rope, and a balance weight 110 balancing with the car 109 is connected to the other end of the rope. The following control units are additionally connected for the speed and leveling control of the conventional elevator system. Current detectors 104 are connected to a current supply path from the inverter 103 to the alternating current motor 106 in order to detect a current flowing through the motor 106. A pulse generator 107 detecting a rotation speed of the motor 106 and outputting a resultant pulse signal is connected to the output axis of the motor 106. A load detector 111 is disposed at a low portion of the load detector 111, and detects and outputs the load of the car 109.

As depicted in FIG. 2, a position detection unit 112 disposed at an upper portion of the car 109 includes a pair of position detectors PA, PB. Each position detector PA, PB is provided with a photo-coupler or a magnetic switch (not shown). On the other hand, a shielding plate SP is disposed at a predetermined height from each floor bottom surface of the walls of the hoist way, and detects a position of the car 109 by intercepting an optical transmission or magnetic flux of the position detectors PA, PB.

According to output signals from the position detectors PA, PB, a level difference detection unit 113 detects a state where the bottom level of the car 109 is identical to the bottom level of the designated floor (FIG. 2(*a*)), a state where the bottom level of the car 109 is higher than the bottom level of the designated floor (FIG. 2(*b*)) or a state where the bottom level of the car 109 is lower than the bottom level of the designated floor (FIG. 2(*c*)), thereby outputting an output signal corresponding to the respective states.

A level compensation operation command generator 114 is connected to an output from the level difference detection unit 113. When the level difference is generated as shown in FIG. 2(*b*) or 2(*c*), the level compensation operation command generator 114 outputs a corresponding lifting or lowering level compensation operation command signal LCD as shown in FIG. 3*d* according to an output signal from the level difference detection unit 113.

A speed command generator 115 is connected to an output from the level compensation operation command generator 114. In case the level compensation operation command generator 114 generates the lifting or lowering level compensation operation command signal LCD, the speed command generator 115 outputs a level compensation speed pattern signal LCV as shown in FIG. 3*e*.

A speed controller 116 is connected to an output from the speed command generator 115 and an output from the pulse generator 107, computes a speed difference of the motor 5 according to a speed command value of the level compensation speed pattern signal LCV from the speed command generator 115 and a pulse signal from the pulse generator 107, and outputs a torque component current command signal $I\tau^*$ of the motor corresponding to the difference value.

A load current converter 117 is connected to an output from the load detector 111, and outputs a load compensation torque signal it_ub1 representing a detection load (a load resulting from a weight difference between the car 109 and the balance weight 110, which must be torque-compensated) from the load detector 111 as a current value.

A current controller 118 is connected to an output from the speed controller 116, an output from the current detector 104 and an output from the load current converter 117, and adds a current value corresponding to a detection load amount represented by the load compensation torque signal it_ub1 from the load current converter 117 into a difference value between a torque component current command value represented by the torque component current command signal $i\tau^*$ from the speed controller 116 and a current value flowing through the motor 106 from the current detector 104, thereby outputting a current command signal it* corresponding to the torque amount to be finally compensated.

A pulse width modulator 119 is connected to an output from the current controller 118, generates a pulse width modulation signal corresponding to the current command signal it* from the current controller 118, provides the pulse width modulation signal to the inverter 103, and switching-controlling the inverter 103.

The leveling operation of the conventional leveling control device for the elevator system will now be explained with reference to FIGS. 1 to 4.

After the input alternating current power source AC is converted into a direct current voltage through the AC/DC converter 101, if the ripple component is removed by the condenser 102, it becomes an almost complete direct current voltage, and is applied to the inverter 103. The power semiconductor devices such as power transistors constituting the inverter 103 are switched to a predetermined pattern according to a switching control signal outputted from the switching signal generator 119, and thus convert the inputted direct current voltage into the alternating current voltage. The converted alternating current voltage is applied to the motor 106, thus driving the motor 106. The motor 106 rotates the sheave 108, and thus the car 109 and the balance weight 110 start a linear motion in the opposite direction. As a result, the car 109 starts to move toward the designated floor according to the switching signal supplied to the inverter 103.

In case the car 109 stops at the designated floor so that the bottom level of the car 109 can be identical to the bottom level of the designated floor, as shown in FIG. 2(*a*), the level compensation operation is not performed.

However, as shown in FIG. 2(*b*), when the bottom level of the car 109 is higher than the bottom level of the designated floor, the position detector PA of the position detection unit 112 is ON, but the position detector PB thereof is OFF. At this time, the door of the car 109 is opened. In addition, when the car 109 stops at the designated floor, if the bottom level of the car 109 is lower than the bottom level of the designated floor, the position detector PA is OFF, but the position detector PB is OFF.

As described above, in the case that the bottom level of the car 109 is higher or lower than the bottom level of the designated floor, according to the ON or OFF state signal of the position detectors PA, PB, the level difference detection unit 113 detects that the level difference is generated in an upward or downward direction, and outputs a signal showing this to the level compensation operation command generator 114. Thus, as shown in FIG. 3*d*, the level compensation operation command generator 114 outputs the level compensation operation command LCD in the upward or downward direction at the point ts.

Accordingly, the speed command generator 115 receiving the level compensation operation command LCD outputs the level compensation speed command LCV The LCV signal is increased in an exponential function method, as shown in FIG. 3*e*. The car 109 is operated at a constant speed Vs after the time ts. As shown in FIG. 2(*a*), when the bottom level of the car 109 is identical to the bottom level of the designated floor, the position detectors PA, PB are all OFF. Here, the level compensation operation command LCD is extinguished at the time tv as in FIG. 3, and the level compensation speed command LCV is reduced to zero (0) in the exponential function method.

On the other hand, the conventional leveling control operation for the elevator system will now be described with reference to FIG. 4. FIG. 4 is a block diagram illustrating main components of the conventional leveling control device for the elevator system as shown in FIG. 1. A subtracter 401 receives a speed command Wm* and an actual speed Wm, and outputs a difference. The speed controller 116 receives the difference, and outputs a torque command current $i\tau^*$ in order to compensate the difference. While the level compensation operation is performed, the load current converter 117 outputs the load compensation torque current it_ub1 to an adder 402 in order to compensate the load detected by the load detector 111. The adder 402 adds the load compensation torque current it_ub1 and the torque current $i\tau^*$, and outputs the final torque command current it*. The final torque command current it* controls the motor 106 through a current controller and power rectifier 403. Here, the current controller and power rectifier 403 include the current controller 118, the pulse width modulator 119 and the inverter 103.

In an ideal case, the alternating current motor 106 can generate the torque command Tm corresponding to the final torque current it* ($it^*=i\tau^*+it_ub1$) by the current controller and power rectifier 403. The torque command Tm must be identical to a weight difference between the car 109 and the balance weight, namely an unbalanced torque TL. However, the load detected by the load detector 111 has an error when the passengers get in or off at the designated floor. As a result, a mechanical system (movable mechanical system included in the elevator system, such as the car 109, balance weight 110, sheave 108 and rope) having an inertia due to a torque Tm−TL corresponding to the error of the load is accelerated. When it is presumed that the mechanical system is a rigid body, a mass thereof is J, a speed thereof is Wm, and an acceleration thereof is $d\,Wm/dt=Wm\times S$ (differential operator), the mechanical system is accelerated at an acceleration of $Wm\times S$. The torque of the mechanical system moving at the acceleration is $J\times Wm\times S$. The speed Wm of the elevator car can be obtained by a multiplier of $1/(J\times S)$. On the other hand, when the unbalanced torque TL is not identical to the load compensation torque current it_ub1 , that is when there is a difference between the load torque applied to the rotation axis of the motor 106 and the detection load detected by the load detector 111, the speed is varied as much as the difference, and the speed controller 116 outputs the torque current $i\tau^*$ in order to reduce the speed variation. Here, in the case that a gain of the speed controller is sufficiently large, it is possible to rapidly respond to the speed variation. However, in the conventional elevator system, the gain of the speed controller 116 cannot be sufficiently increased due to a ride comfort. Accordingly, a big difference between the unbalanced torque TL and the load compensation torque current it-ub1 causes many problems in the level compensation operation. For example, as shown in FIG. 2(*b*), while the car exceeds the bottom level by a predetermined level in the upward direction from the reference position after the passenger gets off, and the level compensation operation downwardly is carried out, if the passenger gets in the car from the hall, the car 109 exceeds the bottom level by a predetermined level in the downward direction, and thus the level compensation operation is upwardly performed. Consequently, the level compensation operation time becomes longer.

Accordingly, in the speed control of the conventional elevator system, in case a load amount is sharply varied during the level compensation operation as the passengers get in or off, the speed is varied corresponding to the difference between the unbalanced torque TL and the load compensation torque, thereby more increasing the level difference. As a result, the level compensation operation time is increased, and furthermore the passengers may fall down. In addition, the difference between the unbalanced torque TL and the load compensation torque may be increased due to a response delay according to the structure of the load detector, a mis-detection of the load state, noise and a defect of the load detector.

SUMMARY OF THE INVENTION

Accordingly, it is an object of the present invention to provide a leveling control device for an elevator system which can improve a speed control property of an elevator car in a level compensation operation, by estimating a load torque applied to a rotation axis of an alternating current motor with a torque component current command value and a detection value of a speed of the alternating current motor, and by compensating the torque component current command value for a difference between the estimated load torque and a load compensation torque, while performing the level compensation operation.

BRIEF DESCRIPTION OF THE DRAWINGS

The present invention will become better understood with reference to the accompanying drawings which are given only by way of illustration and thus are not limitative of the present invention, wherein:

FIG. 10(*b*) is a graph showing a speed control property of the elevator system in accordance with the present invention.

DETAILED DESCRIPTION OF THE PREFERRED EMBODIMENTS

Figure 6:
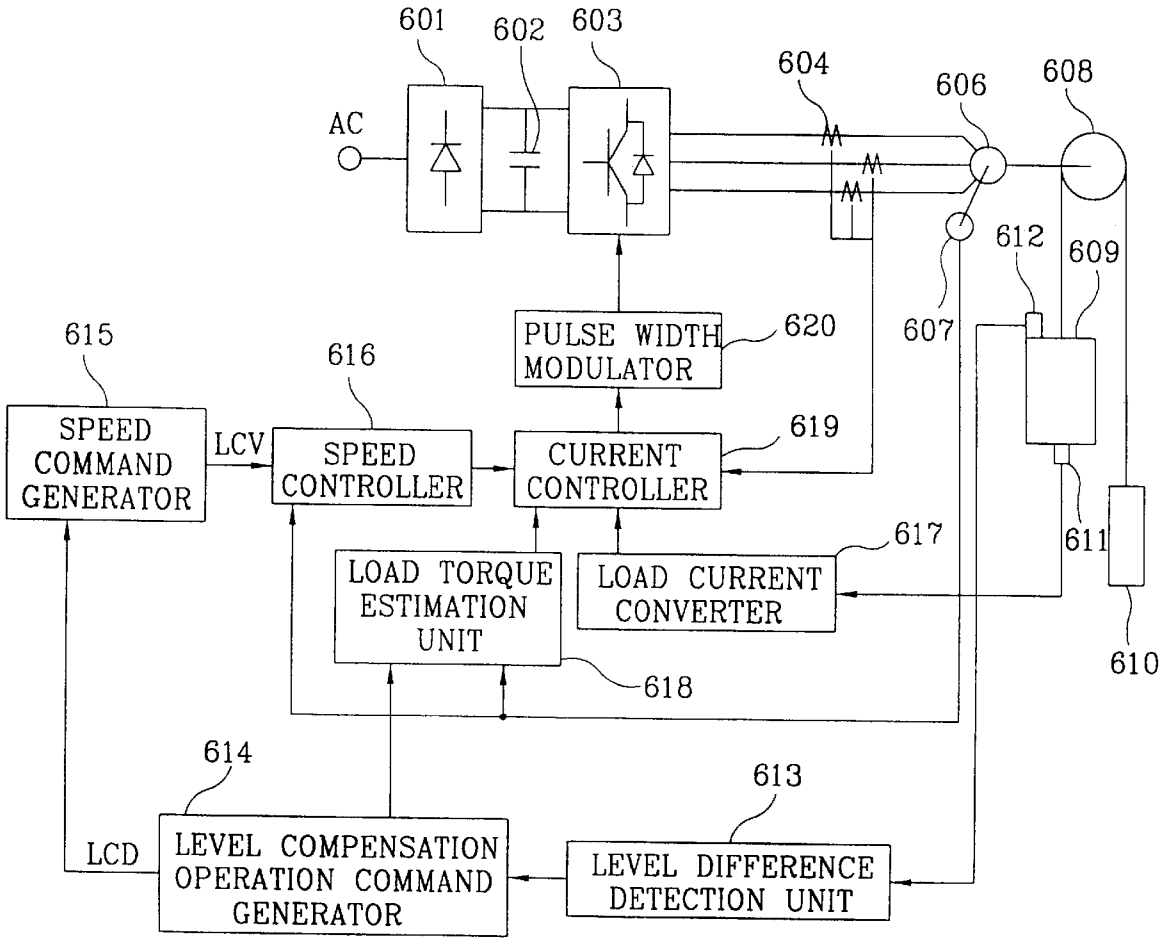
FIG. 6 is a block diagram illustrating a leveling control device for an elevator system in accordance with a first embodiment of the present invention.

A leveling control device for an elevator system in accordance with the present invention will now be described with reference to FIG. 6. As shown therein, the elevator system includes: an alternating current power source AC; a converter 601 for converting an alternating current from the alternating current power source AC into a direct current; a condenser 602 for smoothing the direct current from the converter 601; an inverter 603 for converting the direct current from the condenser 602 into an alternating current having a variable frequency and voltage; an alternating current motor 606 driven in the clockwise or counterclockwise direction by a three phase alternating current supplied from the inverter; a sheave 608 rotated in the clockwise or counterclockwise direction by the alternating current motor 606; a car 609 connected to one end of a rope winding around the sheave 608, and vertically movable in a hoist way, for loading and transferring the passengers or cargo to a designated floor; and a balance weight 610 connected to the other end of the rope, for balancing with the car 609.

The leveling control device for the elevator system in accordance with the present invention includes: a current detector 604 connected to a supply path of the three phase alternating current supplied from the inverter 603 to the motor 606, for detecting a current value of the alternating current; a pulse generator 607 for detecting a speed of the motor 606, and outputting a corresponding pulse signal; a position detection unit 612 disposed at the car 609, for detecting whether a bottom level of the car 609 is identical to a bottom level of the designated floor; a load detector 611 disposed at a lower portion of the car 609, for detecting a load of the car 609; a load current converter 617 for converting a detection load represented by a load detection signal from the load detector 611 into a corresponding current signal, and outputting it; a level difference detection unit 613 for detecting according to an output signal from the position detection unit 612 whether the bottom level of the car 609 is different from the bottom level of the designated floor, and a direction of a level difference compensation operation; a level compensation operation command generator 614 for outputting a level compensation operation command signal, when receiving from the level difference detection unit 613 a signal showing that the bottom level of the car is different from the bottom level of the designated floor, and the direction of the level difference compensation operation; a load torque estimation unit 618 for estimating an amount of the load applied to an output axis of the motor 606 correspondingly to the speed measured by the pulse generator 607, and outputting the estimated amount of the load as a current signal, when receiving the level compensation operation command signal from the level compensation operation command generator 614; a speed command generator 615 for generating a speed command signal of the motor 606; a speed controller 616 for outputting a speed command value corresponding to a difference value between the speed command signal from the speed command generator 615 and the speed from the pulse generator 607 as a current command signal of the motor 606, in order to compensate a speed difference therebetween; a current controller 619 for outputting a resultant value obtained by adding a torque component current command value represented by the torque component current command signal from the speed controller 616, a current value represented by the estimated load current signal from the load torque estimation unit 618, and a current value according to the detection load from the load current converter 617, as a torque component current compensation command signal; and a pulse width modulator 620 for generating a switching signal to be applied to the inverter according to the torque component current compensation command signal from the current controller 619. The operation of the leveling control device for the elevator system in accordance with the present invention will now be described. When the input alternating current power supply AC is converted into the direct current voltage through the AC/DC converter 601, and a ripple component thereof is removed through the condenser 602, it becomes an almost complete direct current voltage, and is applied to the inverter 603. The power semiconductor devices constituting the inverter 603 are switched to a predetermined pattern according to a switching control signal outputted from the pulse width modulator 620, thereby converting the direct current voltage into the alternating current voltage. The converted alternating current voltage is applied to the alternating current motor 606, thereby driving the motor 606. The alternating current motor 606 rotates the sheave 608, and therefore the car 609 and the weight balance 610 start a linear motion in the opposite direction. As a result, the car 609 starts to move toward the designated floor according to the switching signal supplied to the inverter 603.

Figure 1:
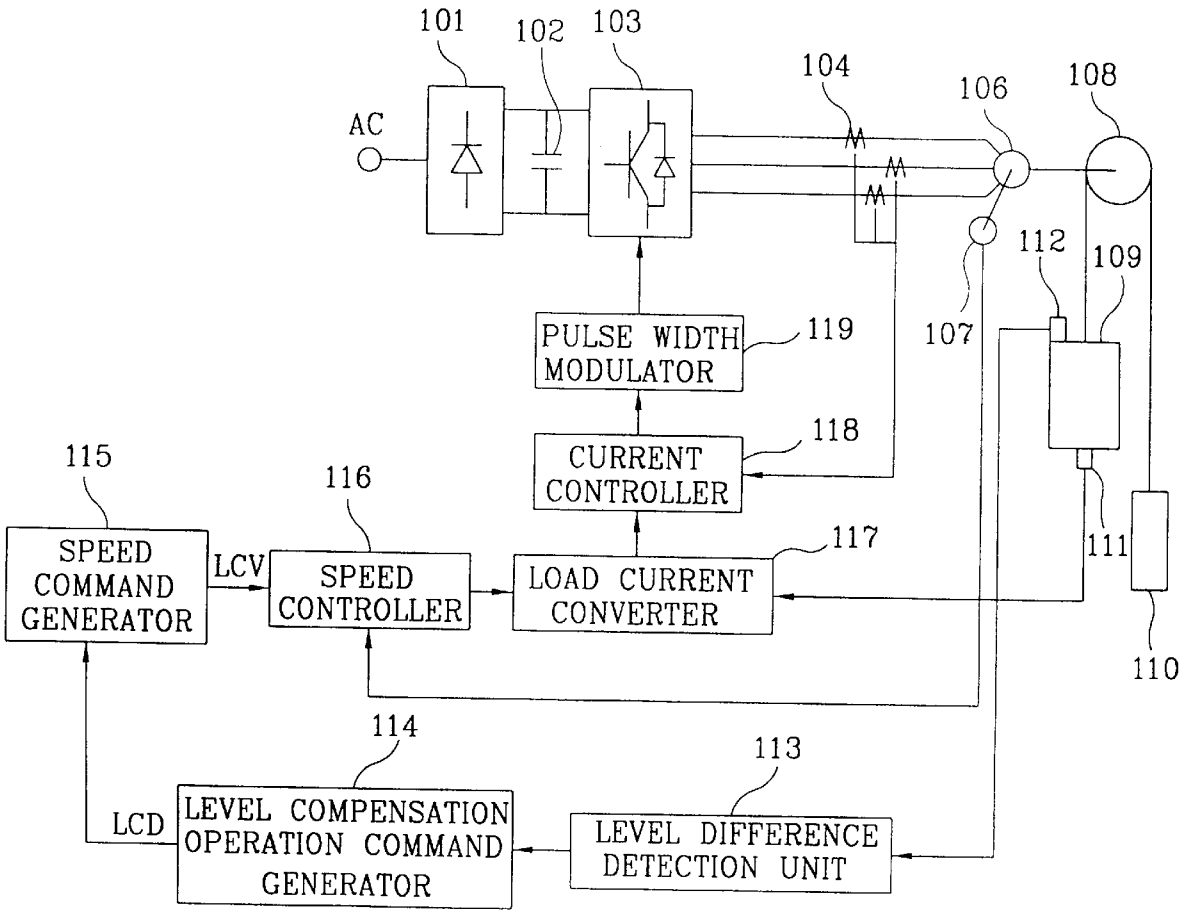
FIG. 1 PRIOR ART
FIG. 1 is a block diagram illustrating a conventional leveling control device for an elevator system.
Figure 2A:
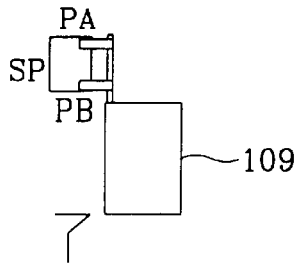
FIG. 2A PRIOR ART
FIGS. 2(*a*) to 2(*c*) are operational diagrams of a position detector showing level compensation conditions, respectively.
Figure 2B:
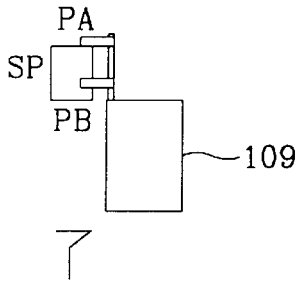
FIG. 2B PRIOR ART
Figure 2C:
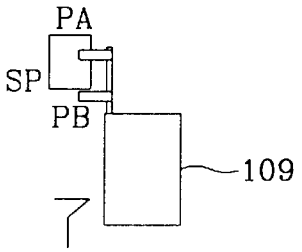
FIG. 2C PRIOR ART
Figure 3A:
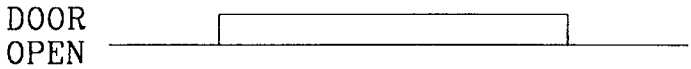
FIG. 3A PRIOR ART
FIGS. 3(*a*) to 3(*e*) are waveform diagrams of signals during a level compensation operation, respectively.
Figure 3B:
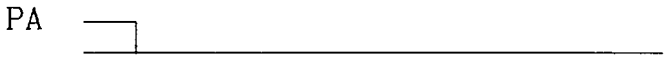
FIG. 3B PRIOR ART
Figure 3C:
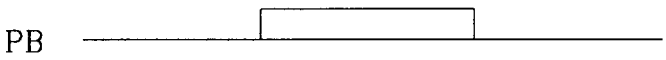
FIG. 3C PRIOR ART
Figure 3D:
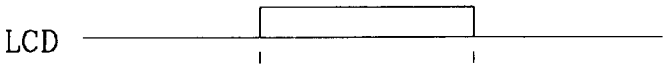
FIG. 3D PRIOR ART
Figure 3E:
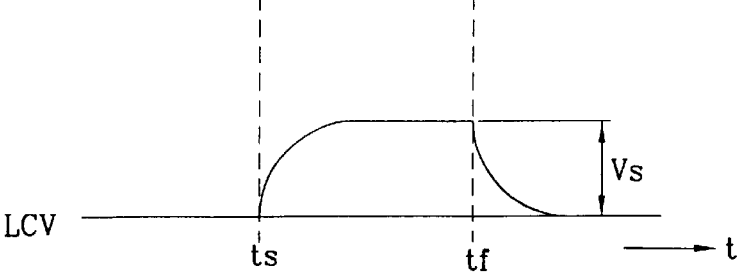
FIG. 3E PRIOR ART
Figure 4:
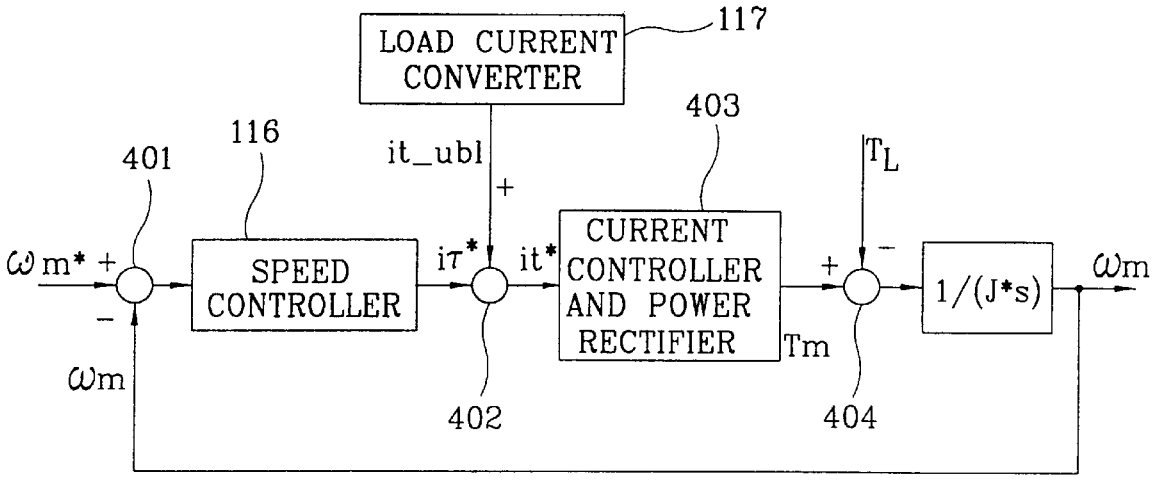
FIG. 4 PRIOR ART
FIG. 4 is an operational diagram illustrating the conventional leveling control device for the elevator system.
Figure 5:
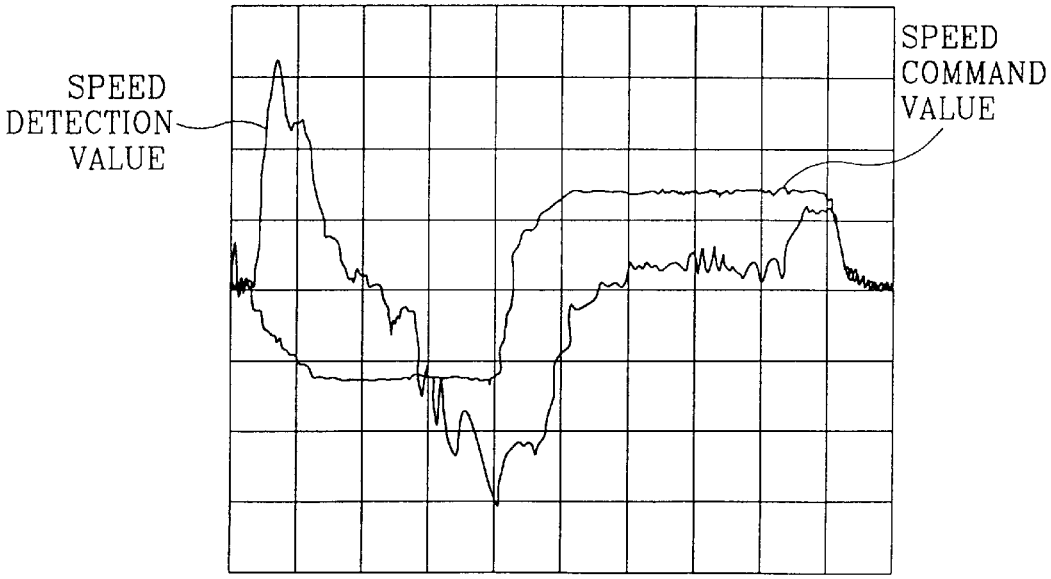
FIG. 5 PRIOR ART
FIG. 5 is a graph showing a speed control property during the level compensation operation of the conventional elevator system.

On the other hand, when the car 609 is operated, the position detection unit 612 disposed at the upper portion of the car 609 outputs the detection signal according to the state where the bottom level of the car 609 is identical to, higher or lower than the bottom level of the designated floor, as shown in FIGS. 2(*a*) to 2(*c*).

Accordingly, the level difference detection unit 613 detects a state where the bottom level of the car is not identical to the bottom level of the designated floor, and the direction of the level compensation operation, and outputs them to the level compensation operation command generator 614, according to the position detection signal inputted from the position detection unit 612. The level compensation operation command generator 614 outputs the level compensation operation command LCD.

The above-described operation is similar to the conventional art. The leveling control device for the elevator system including the load torque estimation unit in accordance with the present invention will now be explained in detail with reference to FIGS. 7 and 8.

Figure 8:
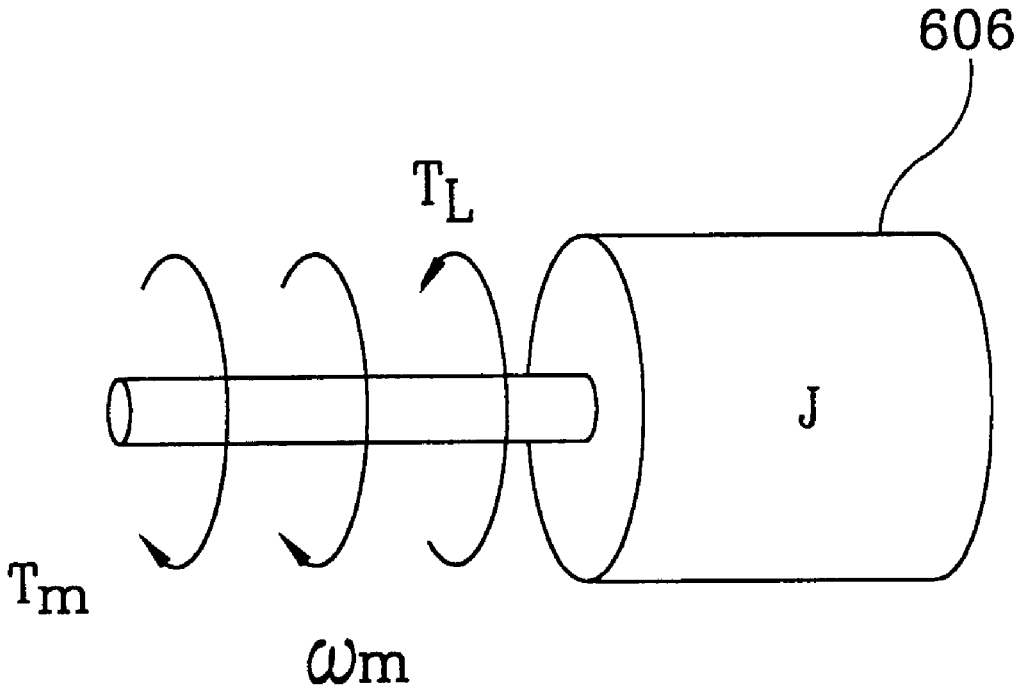
FIG. 8 illustrates a rigid body model of an elevator mechanical system.

Firstly, the following torque equation is obtained by using the movable mechanical system such as the sheave, rope, car and balance weight as a single rigid body as shown in FIG. 8.

$$Tm = J\frac{dwm}{dt} + TL \tag{1}$$

Here, Tm is a torque command value necessary to move the rigid body at a speed of Wm, J is a mass of the rigid body, $$\frac{dwm}{dt}$$

is an acceleration thereof, and TL is an actual amount of the load applied to the output axis of the motor 606.

The relation among the actual load torque TL applied to the output axis of the alternating current motor 606, a load compensation torque $\hat{T}L$ for compensating the load of the car 609 detected by the load detector 611, and an error $\Delta TL$ of the load compensation torque $\hat{T}L$ is represented by Expression (2).

$$TL=\hat{T}L+\Delta TL \tag{2}$$

The relation expression among an estimated torque $\tilde{T}L$ of the actual load torque TL applied to the axis of the alternating current motor 606, the load compensation torque $\hat{T}L$ for compensating the load detected by the load detector 611, and the error $\Delta TL$ of the load compensation torque $\hat{T}L$ is represented by Expressions (3) and (4).

$$\tilde{T}L=Tm-J\varpi ms=\hat{T}L+\Delta TL \text{ (here, 's' is a differential operator)} \tag{3}$$

$$\Delta TL=\tilde{T}L-\hat{T}L \tag{4}$$

In order to use the result obtained by Expression (3) for the speed control of the alternating current motor 606, it is preferable to employ a low pass filter to prevent a misoperation by a high frequency noise. When the low pass filter is represented by a transfer function, it is satisfied that $G(s)=1/(1+\tau s)$. Here, G(s) is a transfer function of the low pass filter, '$\tau$' is a time constant, and 's' is a differential operator. Here, in case '$1/\tau$' is multiplied by a denominator and a numerator and '$1/\tau=g$' is satisfied, $G(s)=g/s+g$. Accordingly, $\tilde{T}L=Tm-J\varpi ms$ after being filtered by the low pass filter is represented by Expression (5).

$$\tilde{T}L = \frac{g}{s+g}(Tm - J\varpi ms) = \frac{gTm}{s+g} - \frac{gJ\varpi ms}{s+g} \tag{5}$$

When Expression (5) is processed in order for its denominator not to include the differential operator, it is represented by Expression 6.

$$\begin{aligned}\tilde{T}L &= \frac{gTm}{s+g} - \frac{Jg\varpi m(s+g)}{s+g} + \frac{Jg^2\varpi m}{s+g} \\ &= \frac{g}{s+g}(Tm - g\varpi m) - Jg\varpi m\end{aligned} \tag{6}$$

In Expression (6), Tm is in proportion to a torque current it*, and a proportional constant is a torque constant kt.

Figure 7:
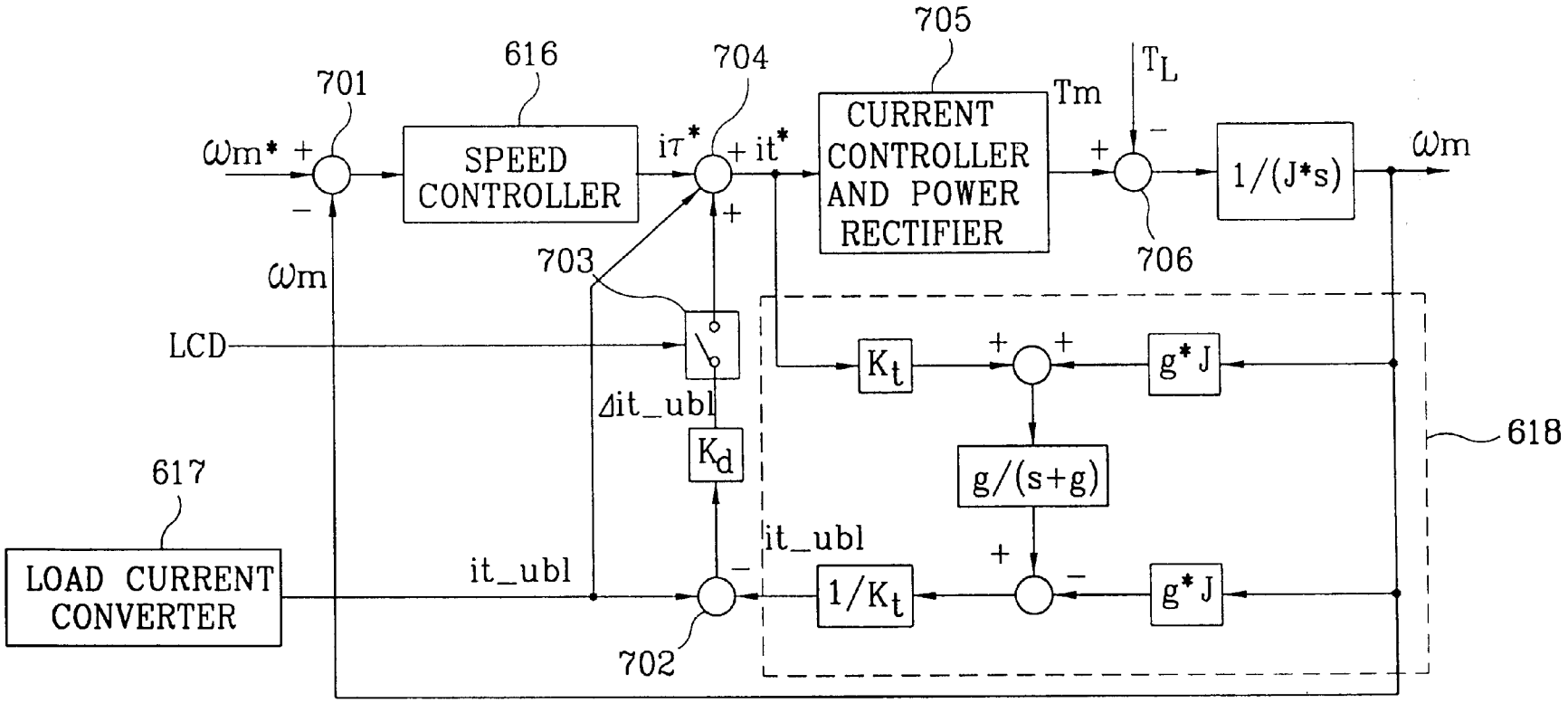
FIG. 7 is a detailed block diagram illustrating main components of the leveling control device for the elevator system in accordance with the present invention.

FIG. 7 is a block diagram illustrating main components of the leveling control device in accordance with the present invention utilizing Expressions (4) and (6). As shown therein, a speed control block includes: the speed controller 616 for receiving a difference between the speed $\varpi$m of the alternating current motor 606 and the speed command $\varpi$m*, and outputting the torque current Iτ*; the load torque estimation unit 618 for estimating the load torque from the final torque component current command it* outputted from an adder 704 disposed at the output terminal of the speed controller 616 and the speed $\varpi$m of the alternating current motor 606, and outputting the estimated torque current it_ub1 ; a subtracter 702 for computing a difference Δit_ub1 between the estimated torque current it_ub1 and the load compensation torque current It_ub1 which is an output from the load current converter 617; a switch 703 short by the level compensation operation command signal LCD, for transmitting the difference Δit_ub1 outputted from the subtracter 702 to the adder 704; and the adder 704 for adding the torque current iτ* outputted from the speed controller 616, the difference Δit_ub1 supplied through the switch 703, and the load compensation torque current it_ub1, and outputting the torque current it* to a current controller and power rectifier 705. The operation of the speed control block will now be explained. The speed controller 616 receives the difference between the speed command $\varpi$m* and the actual speed $\varpi$m through the subtracter 701, and outputs the current command iτ*. The load torque estimation unit 618 estimates the load torque from the torque current it* which is the output from the adder 704 disposed at the output terminal of the speed controller 616 and the speed $\varpi$m of the alternating current motor 606, and outputs the estimated torque current it_ub1.

In addition, the subtracter 702 computes the difference Δit_ub1 between the estimated torque current it_ub1 which is the output from the load torque estimation unit 618 and the load compensation torque current it_ub1 which is the output from the load current converter 617, and supplies it to one side terminal of the switch 703. The difference Δit_ub1 is supplied to the adder 704 through the switch 703 according to the level compensation operation command signal LCD outputted from the level compensation operation command generator 614, and added to the current command iτ* outputted form the speed controller 616, thereby responding to the load variation and rapidly compensating the current command iτ*. Here, as illustrated in FIG. 7, the difference Δit_ub1 may be varied by adjusting again kd.

Figure 9:
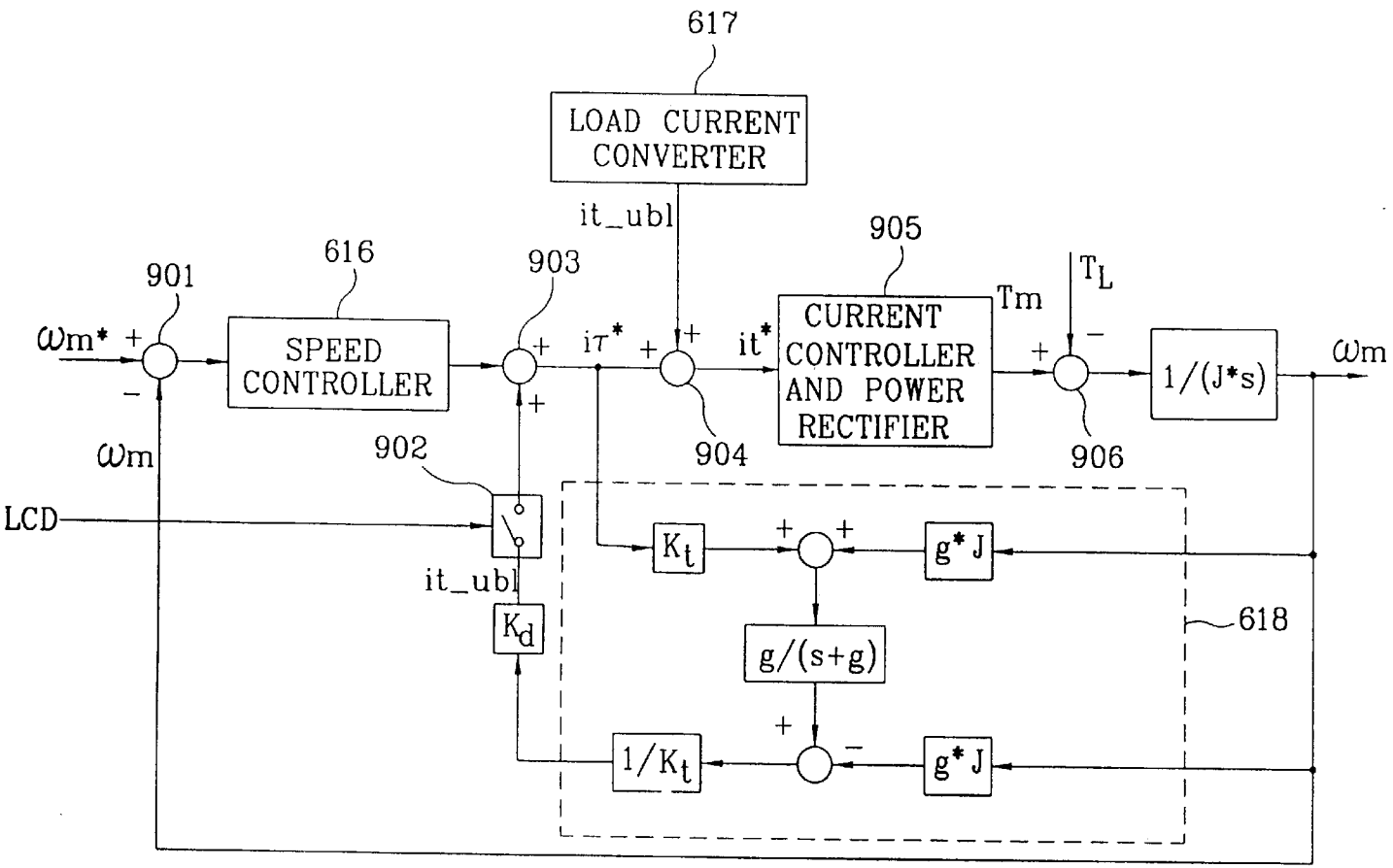
FIG. 9 is a block diagram illustrating main components of the leveling control device for the elevator system in accordance with another embodiment of the present invention.

On the other hand, FIG. 9 shows the speed control of the elevator system according to another embodiment of the present invention. Differently from FIG. 7, the estimated torque current it_ub1 is supplied to one side terminal of a switch 902 as it is, instead of computing the difference between the estimated torque current it_ub1 estimated by the load torque estimation unit 618 and the load compensation torque current it_ub1 outputted from the load current converter 617.

As a result, the above-described process overcomes the phenomenon that the level difference and the level compensation time are increased in the level compensation operation due to the speed variation resulting from the difference between the unbalanced torque TL and the load compensation torque.

Figure 10A:
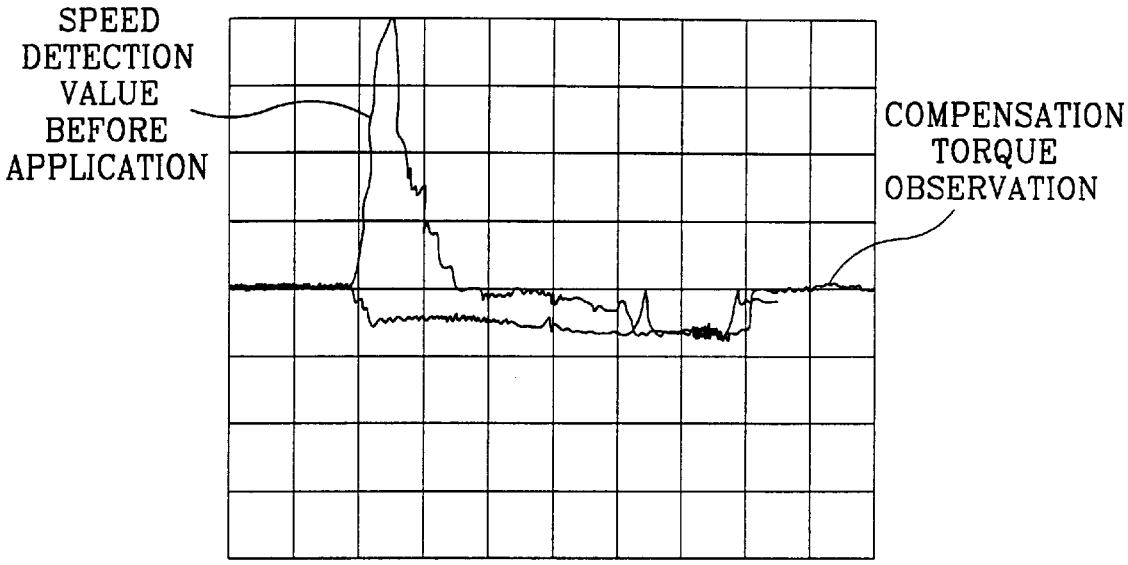
FIG. 10(*a*) is a graph showing a property of a speed variation and a computed compensation torque before applying the present invention.
Figure 10B:
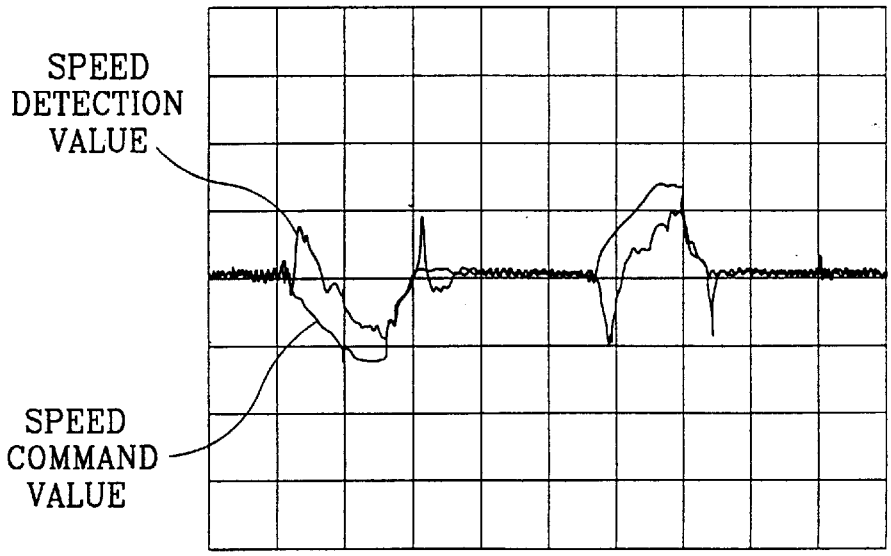

FIG. 10(*a*) shows a speed variation and a compensation torque computed in the load torque estimation unit 618 before applying the present invention, in the case that there is a big difference between the load compensation torque for compensating the load detected from the load detector 611 and the actual load torque applied to the axis of the alternating current motor 606, and FIG. 10(*b*) shows a speed variation and a speed command value in the level compensation operation in accordance with the present invention.

As discussed earlier, the leveling control device for the elevator system in accordance with the present invention estimates the load torque applied to the axis of the alternating current motor on the basis of the torque current component and the alternating current motor speed, while carrying out the level compensation operation, and compensating the torque current component for the difference between the estimated load torque and the load compensation torque by the output signal from the load detector, thereby overcoming the phenomenon that the level difference and the level compensation time are increased in the level compensation operation due to the speed variation resulting from the difference between the unbalanced torque TL and the load compensation torque, and improving the speed control property in the level compensation operation of the elevator system.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In an elevator system including: an alternating current power source; a converter for converting an alternating current from the alternating current power source into a direct current; a condenser for smoothing the direct current from the converter; an inverter for converting the direct current from the condenser into an alternating current having a variable frequency and voltage; an alternating current motor driven in the clockwise or counterclockwise direction by a three phase alternating current supplied from the inverter; a sheave rotated in the clockwise or counterclockwise direction by the alternating current motor; a car connected to one end of a rope winding around the sheave, and vertically movable in a hoist way, for loading and transferring the passengers or cargo to a designated floor; and a balance weight connected to the other end of the rope, for balancing with the car, a leveling control device for the elevator system, comprising:

a current detector connected to a supply path of the three phase alternating current supplied from the inverter to the motor, for detecting a current value of the alternating current;

a pulse generator for detecting a speed of the motor, and outputting a corresponding pulse signal;

a position detection unit disposed at the car, for detecting whether a bottom level of the car is identical to a bottom level of the designated floor;

a load detector disposed at a lower portion of the car, for detecting a load of the car;

a load current converter for converting a detection load represented by a load detection signal from the load detector into a corresponding current signal, and outputting it;

a level difference detection unit for detecting according to an output signal from the position detection unit whether the bottom level of the car is different from the bottom level of the designated floor, and a direction of a level difference compensation operation;

a level compensation operation command generator for outputting a level compensation operation command signal, when receiving from the level difference detection unit a signal showing that the bottom level of the car is different from the bottom level of the designated floor, and the direction of the level difference compensation operation;

a load torque estimation unit for estimating an amount of the load applied to an output axis of the motor correspondingly to the speed measured by the pulse generator, and outputting the estimated amount of the load as a current signal, when receiving the level compensation operation command signal from the level compensation operation command generator;

a speed command generator for generating a speed command signal of the motor;

a speed controller for outputting a speed command value corresponding to a difference value between the speed command signal from the speed command generator and the speed from the pulse generator as a current command signal of the motor, in order to compensate a speed difference therebetween;

a current controller for outputting a resultant value obtained by adding a torque component current command value represented by the torque component current command signal from the speed controller, a current value represented by the estimated load current signal from the load torque estimation unit, and a current value according to the detection load from the load current converter, as a torque component current compensation command signal; and a pulse width modulator for generating a switching signal to be applied to the inverter according to the torque component current compensation command signal from the current controller.

2. The device according to claim 1, wherein the load torque estimation unit comprises:

a current torque converter for computing a torque command value by multiplying a first gain value by the torque component current command signal from the speed controller;

a first multiplier for multiplying the speed value detected by the pulse generator by 'g×J', and outputting it, wherein 'g' is 1/(time constant of low pass filter), and 'J' is a mass value when a mechanical device of the elevator system including the car, rope balance weight and sheave is presumed to be a single mass body;

a first adder for adding an output value from the first multiplier to the torque command value from the current torque converter, and outputting it;

a second multiplier for multiplying an output value from the first adder by 'g/(s+g)', and outputting it, wherein 'g' is 1/(time constant of low pass filter), and 's' is a differential operator, a third multiplier for multiplying the speed value detected by the pulse generator by 'g×J', and outputting it, wherein 'g' is 1/(time constant of low pass filter), and 'J' is a mass value when a mechanical device of the elevator system including the car, rope balance weight and sheave is presumed to be a single mass body;

a subtracter for subtracting an output from the third multiplier from an output from the second multiplier, and outputting the resultant value as a compensation torque value; and a torque current converter for dividing the compensation torque value from the subtracter by the first gain value, and outputting the resultant value as a signal showing the compensation torque value.

3. The device according to claim 1, further comprising:

a second subtracter for subtracting a current value corresponding to the detection load from the load current converter from a current value corresponding to the compensation torque value from the torque current converter, and outputting it;

a switching unit switched to supply or intercept an output current value from the second subtracter according to the level compensation operation command signal from the level compensation operation command generator; and a second adder for adding the output current value from the switching unit and the load current value from the load current converter to the torque component current command value from the speed controller, and outputting the resultant value to the current controller as a current command signal.

4. The device according to claim 3, further comprising: a gain converter for multiplying the output current value from the second subtracter by a second gain value, and outputting it.

5. The device according to claim 1, further comprising:

a switching unit switched to supply or intercept an output current value from the torque current converter according to the level compensation operation command signal from the level compensation operation command generator;

a second adder for adding the output current value from the switching unit to the torque component current command value from the speed controller, and outputting it; and a third adder for adding the load current value from the load current converter to an output from the second adder.

6. The device according to claim 1, further comprising: a gain converter for multiplying the output current value from the torque current converter by a second gain value, and outputting it.

7. The device according to claim 2, further comprising:

a second subtracter for subtracting a current value corresponding to the detection load from the load current converter from a current value corresponding to the compensation torque value from the torque current converter, and outputting it;

a switching unit switched to supply or intercept an output current value from the second subtracter according to the level compensation operation command signal from the level compensation operation command generator; and a second adder for adding the output current value from the switching unit and the load current value from the load current converter to the torque component current command value from the speed controller, and outputting the resultant value to the current controller as a current command signal.

8. The device according to claim 2, further comprising:

a switching unit switched to supply or intercept an output current value from the torque current converter according to the level compensation operation command signal from the level compensation operation command generator;

a second adder for adding the output current value from the switching unit to the torque component current command value from the speed controller, and outputting it; and a third adder for adding the load current value from the load current converter to an output from the second adder.

* * * * *

UNITED STATES PATENT AND TRADEMARK OFFICE

CERTIFICATE OF CORRECTION

PATENT NO. : 6,283,252 B1
DATED : September 4, 2001
INVENTOR(S) : Jea Pil Lee

It is certified that error appears in the above-identified patent and that said Letters Patent is hereby corrected as shown below:

Title page,
Item "[54]", please correct the title from "LEVELING CONTROL DEVICE FOR ELEVATOR SYSTEM" to -- LEVELING CONTROL DEVICE USING LOAD TORQUE ESTIMATION FOR ELEVATOR SYSTEM --

Signed and Sealed this

Ninth Day of April, 2002

*Attest:*

*Attesting Officer*

JAMES E. ROGAN
*Director of the United States Patent and Trademark Office*